US005660725A

United States Patent [19]

Klass

[11] Patent Number: 5,660,725

[45] Date of Patent: Aug. 26, 1997

[54] GULLY EMPTIER HAVING FILTER PROVIDED PIPE AND WEIGHT COMPENSATING SPRING

[76] Inventor: Georg Klass, Moorenweiser Strasse 4, Türkenfeld, Germany

[21] Appl. No.: 448,441

[22] PCT Filed: Dec. 10, 1993

[86] PCT No.: PCT/EP93/03495

§ 371 Date: Jul. 24, 1995

§ 102(e) Date: Jul. 24, 1995

[87] PCT Pub. No.: WO94/13894

PCT Pub. Date: Jun. 23, 1994

[30] Foreign Application Priority Data

Dec. 11, 1992 [DE] Germany ..... 42 41 888.7

[51] Int. Cl.[6] ..... B01D 35/05; B01D 35/01

[52] U.S. Cl. ..... 210/122; 210/241; 210/402; 210/416.1; 210/459

[58] Field of Search ..... 210/122, 241, 210/242.1, 406, 416.1, 459, 460, 396, 402

[56] References Cited

U.S. PATENT DOCUMENTS

| | | | |
|---|---|---|---|
| 1,343,471 | 6/1920 | Otterson | 210/241 |
| 1,345,531 | 7/1920 | Cartwright | 210/241 |
| 2,010,538 | 8/1935 | Evans | 210/241 |
| 3,013,665 | 12/1961 | Schmidt et al. | 210/241 |
| 4,377,475 | 3/1983 | Wiedemann | 210/241 |

*Primary Examiner*—Joseph W. Drodge

*Attorney, Agent, or Firm*—Fattibene and Fattibene; Paul A. Fattibene; Arthur T. Fattibene

[57] ABSTRACT

The present invention relates to a gully emptier comprising a container which has connected thereto a water jet or vacuum/pressure pump for conveying slurry and in which a discharge pipe which is provided with a filter at a liftable and lowerable end is arranged upstream of the connection to the suction side of a low-pressure pump, wherein a float is connected to the filter. Thanks to the float which floats on the water surface, the filter is automatically held at a predetermined depth below the water surface even when the water level changes. A manual adjustment by the operating staff is no longer required. The distance of the filter from the water surface can be accurately adjusted by using a floodable or inflatable float.

20 Claims, 2 Drawing Sheets

GULLY EMPTIER HAVING FILTER PROVIDED PIPE AND WEIGHT COMPENSATING SPRING

Figure 1:
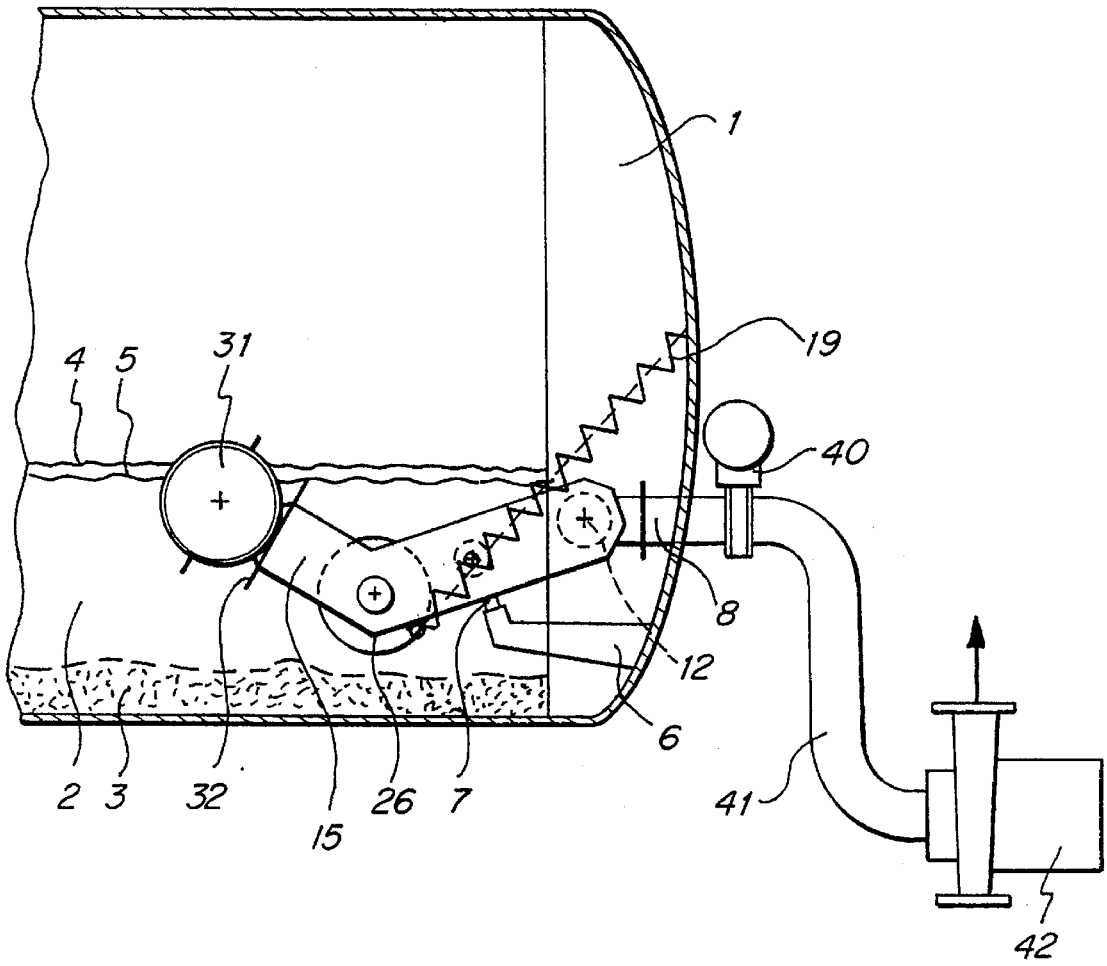

Such a gully emptier is known from German patent specification 30 34 058 which corresponds to U.S. Pat. No. 4,377,475 entitled "Apparatus for Sucking Up and Holding Sludge" issuing to Wiedemann on Mar. 22, 1983, which is herein incorporated by reference. In the gully emptier described therein, water which is carried along in the emptier is sprayed for cleaning, for instance, a sewer. A jet sprays water under high pressure onto the object to be cleaned and is subsequently sucked with the slurry substances removed by such an action into a tank of the gully emptier. In the tank the sucked water is separated from the substances contained therein and is again supplied to the cleaning jet. A discharge pipe provided in the tank for discharging water to be supplied to the cleaning jet is provided with a filter at an end which is liftable and lowerable with the aid of a float so as to separate the coarse particles existing in the tank water. The slurry settles on the bottom of the tank. At a specific level below the water surface, water can be discharged from the tank by taking minimum filtering efforts, since this portion does not contain any substances floating on the water surface, and since the density of the substances depositing downwards under gravitational force is relatively small at a specific height above the settlement layer. To compensate for the gravitational force of the discharge pipes and the filter, the float must have a relatively large size, whereby space is lost for the slurry to be collected and for the cleaning water.

It is the object of the present invention to provide a gully emptier of the above-mentioned type in which the automatic positional mounting of the filter relative to the water surface is improved.

In accordance with the invention, this object is achieved by the compensating springs secured between the tank wall and the filter, the float floating on the water surface can have a considerably smaller size, since the load of the suction pipe is mainly received by the springs and the float just has a control effect. The springs are biased against the gravitational force of the members of the discharge pipe so that the float has only to compensate for a small portion of the gravitational force of the filter and the discharge pipe. The liftable and lowerable end of the outflow line which is provided with the filter is automatically adapted with its height to the changing water surface. This has the advantage that the operating staff need no longer pay attention to the position of the filter in the tank relative to the water surface to readjust the filter in case of need. Since the mechanism for automatically adjusting the filter in its position relative to the water surface is fully within the tank, a vacuum passage through a tank wall on which a guidance lever communicates with the filter is not required. This helps to save costs since such a vacuum passage is relatively expensive to produce and since the reliability of the gully emptier, which is subjected to rough operating conditions, can be increased.

In a special embodiment the float is formed as a rigid hollow body which is connected via a connection to a line extended out of the tank. In this embodiment it can be checked via the line whether the float has been damaged and has become leaky or whether the float can be flooded by supplying water so as to lower the filter to a lower level in the slurry water when substances float on the water surface.

In another preferred embodiment the float consists of a balloon which is filled with gas and consists of a strong flexible material the volume of which can be adjusted in response to the gas filling and which cannot exceed a predetermined maximum volume. As a result, one obtains a variable buoyancy, so that the filter can be held in different positions relative to the water surface. A textile-reinforced plastic sheet is, for instance, suited as a material for such a balloon. Since the maximum volume is defined, a predetermined maximum buoyancy cannot be exceeded even at a variable pressure, in particular, at a negative pressure in the tank.

Other preferred embodiments follow.

Figure 2:
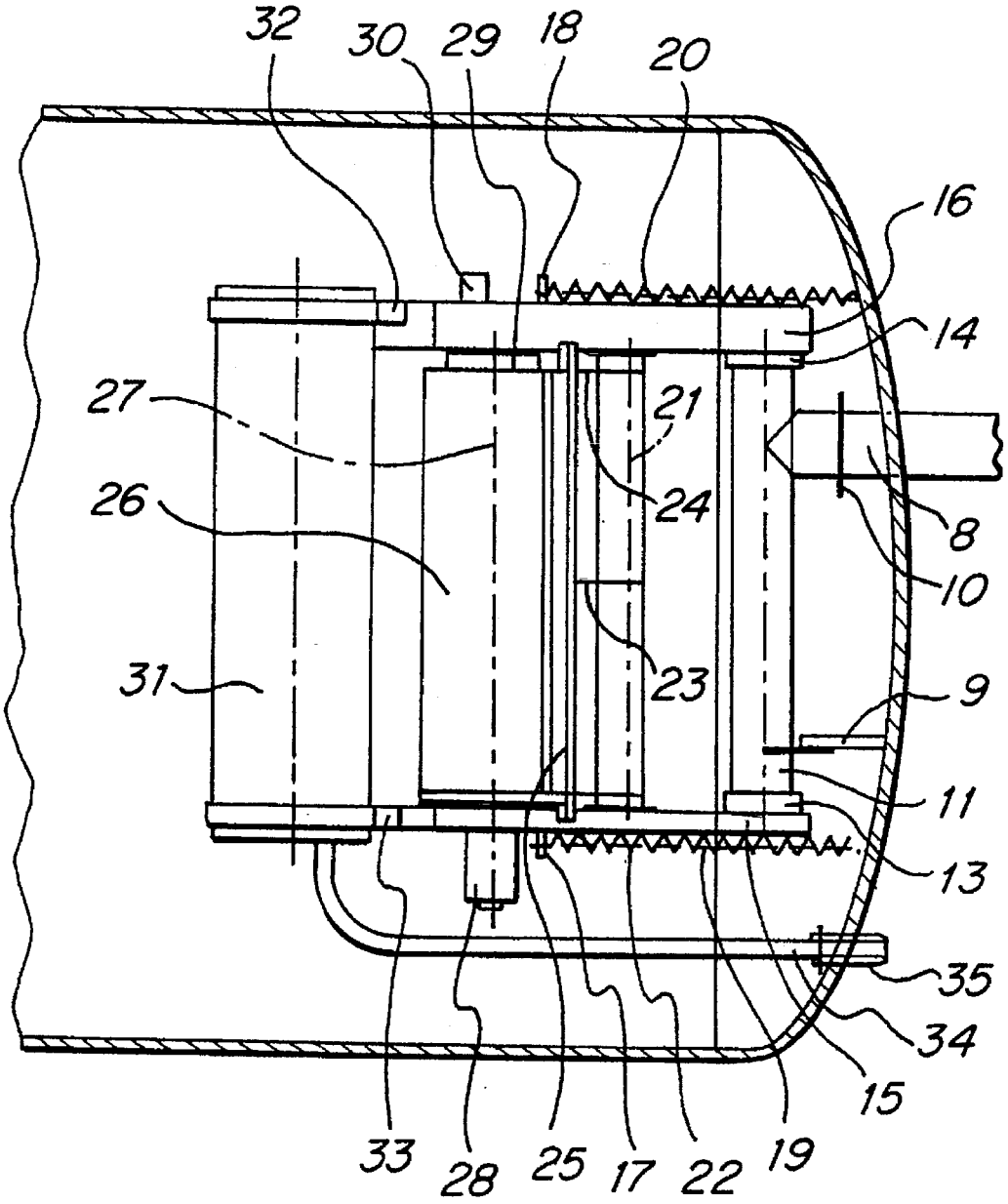

Embodiments of the invention shall now be explained in more detail by way of example with reference to the drawing, in which:

FIG. 1 is a lateral cross-sectional view of the discharge pipe of the gully emptier according to the invention; and FIG. 2 is a top view on the discharge pipe of FIG. 1 in the cut-open state of the tank.

FIGS. 1 and 2 show a tank 1 in which sucked slurry water 2 is collected and on the bottom of which slurry 3 settles. A water surface 4 of slurry water 2 has provided thereunder a filter which is formed as a cage drum 26 and through which the water to be discharged enters into a discharge pipe provided in hollow body 16. The discharge pipe inside the tank consists of another pipe 11 which is connected to a flange 10 of a passage pipe 8 through a tank wall. On the outside of the tank the discharge pipe is provided with a valve 40. A flexible hose line 41 is positioned between valve 40 and a low-pressure pump 42. Cage drum 26 is shaped as a cylinder with rods that are arranged along the cylinder jacket and secured to rings inside the drum. Rings for fastening doctor blade supports are provided at the face ends of the cage drum.

In the illustrated embodiment a float 31 and the cage drum 26 which acts as a coarse filter are mounted between two support frames 15 and 16. The support frames, in turn, are rotatably mounted on pipe 11 which serves as part of the discharge pipe, the axis of pipe 11 being located in a direction perpendicular to the longitudinal direction of the two supports 15 and 16. Pipe 11 is fixedly secured to the tank wall by means of passage pipe 8 and flange 10 and a holding member 9. The two holding points of pipe 11 are each positioned near the lateral ends of the pipe. A rotatable connection flange 13 and 14 is respectively positioned between pipe 11 and supports 15 and 16.

Support 16 is formed as a hollow support and forms, together with passage pipe 8, pipe 11 and cage drum 26, the discharge pipe which is liftable and lowerable at one end. The cage drum 26 is rotatably mounted between supports 15 and 16 and has a rotary flange towards support 16 for permitting water entering through the cage drum to enter through the flange into hollow support 16. The cage drum 26 which rotates about is rotational axis 27 is driven by a drive 28 which is secured to support 15. Between pipe 11 and cage drum 26, a stripper 25 is held between the two supports 15 and 16. Stripper 25 rests on cage drum 26 and strips off externally resting coarse material from the filter drum because of the rotational movement of cage drum 26. Stripper 25 consists of a stripper strip having the length of cage drum 26, the stripper strip being retained by three holding brackets which, in turn, are mounted on a holding rod which is positioned in parallel with axis 27 of cage drum 26 and is rotatably held between supports 15 and 16. Float 31 which in the illustrated embodiment has the shape of a drum and is formed as a rigid hollow body is mounted on the free ends of the two supports 15 and 16. The float is connected to a duct 34. Duct 34 is mounted on a flange 35 which is formed on a passage projecting through the tank. The drum-shaped float is secured via float mountings 32 and 33 to supports 15 and 16.

Tank 1 has mounted thereon a rest strut 6 whose one end has a rest buffer 7 on which a holding member rests in a lower end position. A spiral spring 19 and 20 is respectively mounted on laterally projecting fastening webs 17 and 18 on supports 15 and 16. The spiral springs are each secured to tank 1 with their second end. The two respective fastening points at the ends of the springs are at different levels so that the springs are biased on account of the load with the weight of the members of the discharge pipe. Float 31 which floats on the water surface must therefore compensate a minor portion of the weight of the liftable and lowerable members of the discharge pipe.

As can be seen from the lateral view of FIG. 1, the two holding supports are bent in their center portion. Cage drum 26 is fastened in the downwardly oriented bending portion of the two supports 15 and 16. This has the effect that the cage drum 26 will be immersed entirely in water when in the case of a water level as illustrated in the drawing the axis of float 31 and the rotational axis 12 of holding frames 15 and 16 are at about the same level. Supports 15 and 16 could also be bent in the opposite direction, and the same function would be achieved if the positions of the cage drum and the float were exchanged.

When the water level changes, float 31 which floats on water surface 4 moves downwards or upwards in response to the water level, the two supports 15 and 16 rotating about the rotational axis 12 on pipe 11. The cage drum 26 is moved in its position relative to the water surface according to the division ratio of its arrangement on supports 15 and 16 between the float and rotational axis 12. To prevent cage drum 26 from immersing into the slurry layer 3 which has settled on the bottom, there is provided rest member 6 which defines the downward movement of support 15. A majority of the weight of the free end of the discharge pipe members supported at one side is received by the two spiral springs 19 and 20. Instead of spiral springs, other types of springs can be used in case of a spring suspension to be selected in a suitable manner. For instance, leaf springs may be used. In a preferred embodiment a torsion bar spring is used for partly receiving the weight of the discharge pipe. The torsion bar is in parallel with and in the vicinity of the rotational axis 12. While one end of the torsion bar is secured to tank 1, another end of the torsion bar has provided thereon at a right angle a rest member on which one of the supports is displaceably supported with a slide member. The torsion bar may, for instance, be held in a pipe of a suitable dimension which is secured to tank 1.

In a preferred embodiment, the non-deformable drum-like float 31 is connected to a feed line 34 by which float 31 can be filled with water. The weight of float 31 is thereby increased so that the buoyancy is no longer sufficient for holding float on the water surface. This turns out to be especially useful or desirable whenever a thick layer of floating substances 5 floats on the water surface 4, and the cage drum 26 is to be lowered below said layer of floating substances 5. In cases where the cage drum 26 is not lowered and the float is not filled with water, feed line 34 turns out to be also advantageous, since one can determine via line 34 whether float 31 has been damaged under the rough operating conditions prevailing within tank 1. It is easy to detect damage to float 31, as water exits through line 34 in such a case.

Apart from the illustrated embodiment of float 31 in the form of a rigid drum, use can also be made of a deformable body which is adapted to be filled with gas. Such a balloon body, which is for instance made from a plastic material, is provided with a compressed-gas line and is filled with gas in case of need, so that the balloon will expand against the gravitational force of water and provide for an efficient float. The expansion of the balloon and thus its buoyancy can be controlled by filling the balloon with gas. This will have the effect that the filter can be held below the water surface 4 at different depths, depending on the filling of the balloon with gas. When the balloon is filled completely, the filter will be held very near the water surface, when the ballon is filled halfway, the filter will be held in a center area between the water surface and the deposited slurry layer 3, and when the balloon is hardly filled, the filter is positioned near the settlement layer 3 on the bottom of the tank. The tightness of the tank can be controlled via the gas pressure strength of the system.

Apart from the above-illustrated embodiments of the float as a hollow body, use can be made of a float as a solid body made of a material having a low specific density, such as wood or styrene. With solid bodies, however, it is not possible to influence the buoyancy or weight of the arrangement or to adjust the position of the filter relative to the water surface.

I claim:

1. A gully emptier comprising a tank (1) and in which a discharge pipe is provided with a filter (26) at a liftable and lowerable end thereof and is connected to a float (31) upstream of a connection to the suction side of a low-pressure pump (42), characterized in that at least one spring (19, 20) is connected to said discharge pipe which is arranged with a bias partly compensating for the weight of said discharge pipe.

2. A gully emptier according to claim 1, characterized in that said filter (26) and said float (31) are each secured to first (15) and second (16) support arms, are mounted on said tank to pivot with a first end of said support arms about an axis (12) and are arranged side by side.

3. A gully emptier according to claim 2, characterized in that said float (31) and said filter (26) are secured to said support arms (15, 16) in such a manner that said filter (26) is below the water surface at a predetermined depth in the tank when said float (31) floats on said water surface.

4. A gully emptier according to claim 3, characterized in that said support arms (15, 16) form a bend which is shaped such that said filter (26) is situated substantially in a position below said float (31).

5. A gully emptier according to any one of claims 2 to 4, characterized in that at least one of said support arms (16) is hollow and serves as a part of the discharge pipe.

6. A gully emptier accord to any one of claims 1 to 4, characterized in that said float (31) is a rigid hollow body.

7. A gully emptier according to claim 6, characterized in that said hollow body has a connection (34) which is connected to a line (35) extended out of said tank.

8. A gully emptier according to any one of claims 2 to 4, characterized in that said at least one spring comprises two spiral springs (19, 20) that are held on said tank between fastening means (17, 18) on said support arms (15, 16) and fastening means situated above said axis (12) at an end of said support arms.

9. A gully emptier according to any one of claims 1 to 4, characterized in that said at least one spring comprises a torsion-loaded spring.

10. A gully emptier according to any one of claims 1 to 4, characterized in that said filter (26) consists of a rotating cage drum of rods extending in parallel with a rotation axis (27) of said drum, and that rings for docter blade supports are provided at both of face ends of said drum.

11. A gully emptier according to claim 10, characterized in that a stripper (25) is provided on said rotating cage drum.

12. A gully emptier according to any one of claims 1 to 4, characterized in that a stop is provided for defining a movement of said discharge pipe in a lower end position.

13. A gully emptier comprising:

a tank;

a pump;

a discharge pipe connected to said pump, said discharge pipe, being within said tank, being free to move up and down at one end thereof;

a float attached to said discharge pipe;

a filter placed on said discharge pipe; and a spring connected to said discharge pipe, wherein said discharge pipe is arranged with a bias partially compensating for the weight of said discharge pipe.

14. A gully emptier as in claim 13 further comprising:

first and second support arms secured to said filter and said float, said first and second support arms together mounted at one end to pivot about an axis.

15. A gully emptier as in claim 14 wherein:

said float and said filter are secured to said first and second support arms in such a manner that said filter is below a water surface at a predetermined depth in the tank when said float floats on the water surface.

16. A gully emptier as in claim 15 wherein:

said first and second support arms form a bend which is shaped such that said filter is situated substantially in a position below said float.

17. A gully emptier as in claim 14 wherein:

at least one of said first and second support arms is hollow and serves as a part of said discharge pipe.

18. A gully emptier as in claim 14 further comprising:

stop means, associated with one of said first or second support arms, for stopping said discharge pipe at a lower end position.

19. A gully emptier as in claim 13 wherein:

said float is a rigid hollow body.

20. A gully emptier as in claim 13 wherein:

said filter comprises a rotating cage drum.

* * * * *